United States Patent [19]

Johnston

[11] Patent Number: 4,541,482

[45] Date of Patent: Sep. 17, 1985

[54] OFFSET OPEN BORE SIDEPOCKET MANDREL

[75] Inventor: Russell A. Johnston, Houston, Tex.

[73] Assignee: Camco, Incorporated, Houston, Tex.

[21] Appl. No.: 624,074

[22] Filed: Jun. 25, 1984

[51] Int. Cl.[4] ..... E21B 23/03

[52] U.S. Cl. ..... 166/117.5; 166/242

[58] Field of Search ..... 166/117.5; 417/109, 417/117

[56] References Cited

U.S. PATENT DOCUMENTS

| | | | |
|---|---|---|---|
| 3,741,299 | 6/1973 | Terral | 166/117.5 |
| 3,807,498 | 4/1974 | Terral et al. | 166/117.5 |
| 4,034,806 | 7/1977 | McGinn et al. | 166/117.5 |
| 4,480,686 | 11/1984 | Coussan | 166/117.5 |

*Primary Examiner*—Stephen J. Novosad
*Assistant Examiner*—M. Goodwin
*Attorney, Agent, or Firm*—Fulbright & Jaworski

[57] ABSTRACT

A sidepocket mandrel for use in a well tubing having coaxial threaded connections about an end bore at each end for connection in a well tubing. The body includes a main portion having an open bore and a flow control device receiving pocket offset from the open bore. The longitudinal axis of the open bore is offset from the axis of the end bores. The body includes a space portion both above and below the main body portion for allowing the passage of a well tool of a predetermined length and size which could not pass directly between an end bore and the open bore. The space portions have a bore greater in lateral drift dimension than the open bore and have a length greater than the predetermined length of the well tool whereby the well tool may move laterally in the space portions for alignment with either an end bore or the open bore.

3 Claims, 5 Drawing Figures

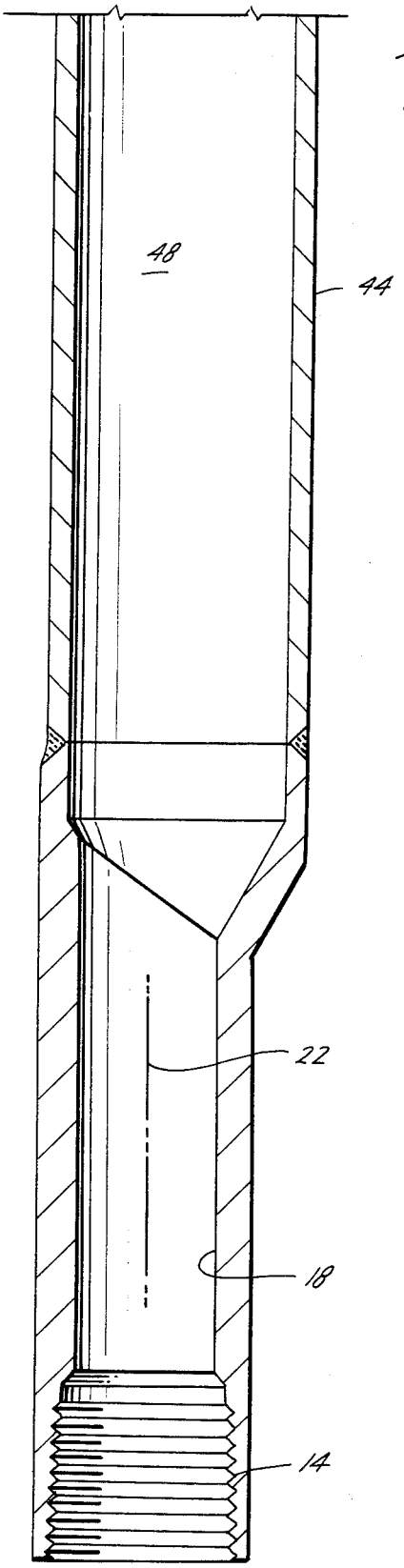
Fig. 1C
Fig. 2
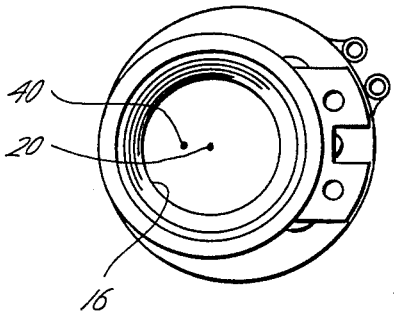
Fig. 3
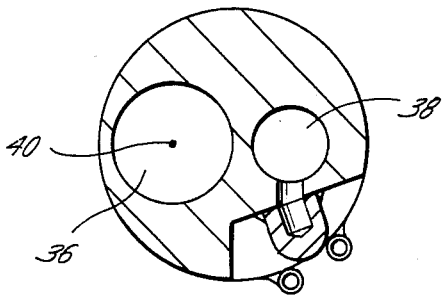

OFFSET OPEN BORE SIDEPOCKET MANDREL

BACKGROUND OF THE INVENTION

It is well known to provide a sidepocket mandrel, as shown in U.S. Pat. No. 3,741,299, having threaded end connections about a bore at each end for connection in a well tubing in which the mandrel body has an open bore in longitudinal alignment with the end bores and a sidepocket offset from the open bore for receiving flow control devices. However, the tubing string and mandrel are enclosed in a well and consequently the lateral space available to provide the internal diameter of the open bore is limited. The open bore and the end bores must have a lateral drift dimension or an internal diameter substantially equal to the bore of the well tubing for avoiding a restriction to the passage of well tools through the mandrel. These various space limitations have created a need for a mandrel in which the longitudinal axis of the open bore is offset from the longitudinal axis of the end bores.

However, with an offset open bore, many well tools that are only slightly smaller than the internal diameter of the well tubing have a length such that the tool cannot pass between one of the end bores and the offset open bore.

The present invention is directed to an improved sidepocket mandrel having an offset open bore with respect to the end bores which will allow a well tool of a predetermined length and outside diameter to readily pass through the mandrel.

SUMMARY

The present invention is directed to a sidepocket mandrel for use in a well tubing having a mandrel body with threaded connections about a bore at each end for connection in a well tubing in which the threaded connections are coaxially aligned. The body includes a main portion which has an open bore and a flow control device receiving pocket offset from the open bore in which the longitudinal axis of the open bore is offset from the longitudinal axis of the threaded connections. The body is provided with a space portion both above and below the main body portion for allowing the passage of a well tool of a predetermined length and size which could not pass directly between an end bore and the open bore. The space portions have a bore having a lateral drift dimension greater than the lateral drift dimension of the open bore and have a length sufficient to allow the passage of a well tool of a predetermined length and outside dimension to move between the end bores and the open bore.

A further object of the present invention is wherein the lateral drift dimension of the open bore of the main body portion is substantially the same as the lateral drift dimension of of the end bores and the well tubing.

Yet a still further object of the present invention is wherein the ends of the end bores and the ends of the open bore which abut the space portion bores are encircled by the ends of the space portion bores.

Still a further object of the present invention is the provision of a well installation having a sidepocket mandrel and a well tool adapted to be longitudinally moved through the mandrel. A sidepocket mandrel includes a body having threaded connections about an end bore at each end for connection in a well tubing and the end bores are coaxially aligned. The body includes a main portion having an open bore and a flow control device receiving pocket offset from the open bore. The open bore has a lateral drift dimension approximately equal to the lateral drift dimension of the end bores and the longitudinal axis of the open bore is offset from the axis of the end bores. The well tool is adapted to be longitudinally moved through the mandrel and has a predetermined length and a maximum outside dimension slightly less than the inside dimension of the end bores and the open bore such that the tools cannot pass directly between an end bore and the open bore. The body includes a space portion above and below the main body portion for allowing the passage of the well tool between an end portion and the open bore. The space portions have a lateral drift dimension greater than the lateral drift dimension of the open bore and has a length greater than the predetermined length of the well tool whereby the well tool may move laterally in the space portions for alignment with an end bore or the open bore.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIGS. 1A, 1B and 1C are continuations of each other and are elevational views, in cross-section, of one type of mandrel including the present invention, FIG. 2 is a cross-sectional view taken along the line 2—2 of FIG. 1A, and FIG. 3 is a cross-sectional view taken along the line 3—3 of FIG. 1B.

DESCRIPTION OF THE PREFERRED EMBODIMENT

Figure 1A:
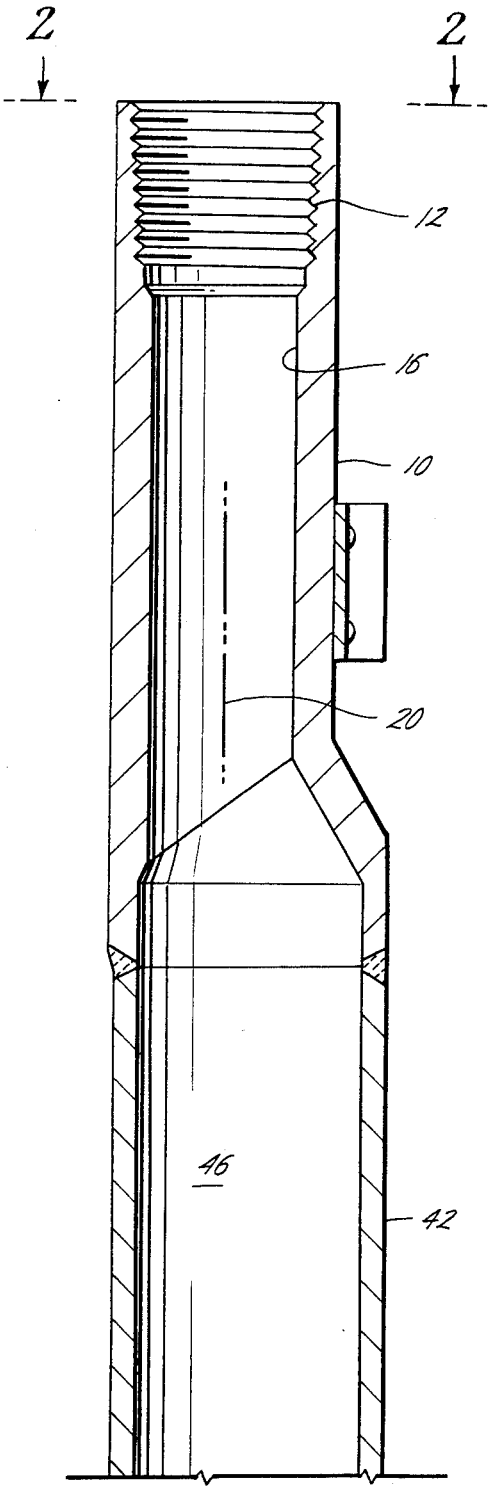
Figure 1B:
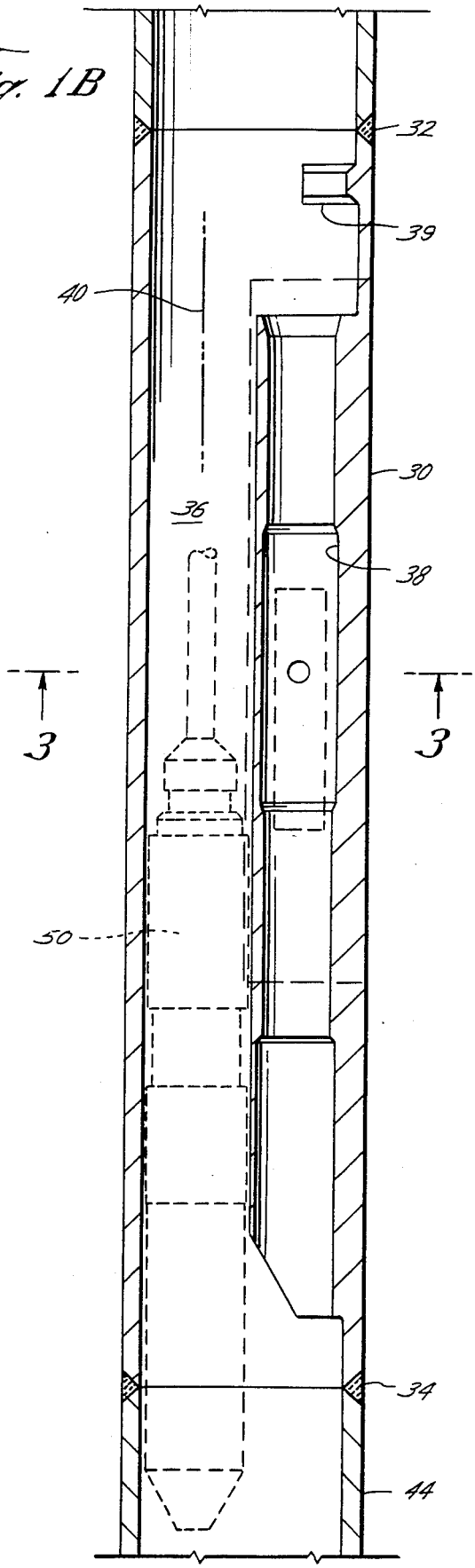

Referring now to the drawings, the reference numeral 10 generally indicates a sidepocket mandrel of the present invention and generally includes threaded connections such as threads 12 and 14 at each end for connection in a well tubing. The threads 12 are about an internal bore 16 and the threads 14 are about an internal bore 18. The bore 16 has a longitudinal axis 20 and the bore 18 has a longitudinal axis 22. The axis 20 and 22 are coaxially aligned. The body 10 includes a main portion 30 connected in the body 10 such as by circular welds 32 and 34. The main body 30 includes an open bore 36 and a flow control device receiving pocket 38 for receiving various types of flow control devices such as a gas lift valve which are releasably locked therein such as by shoulder 39. The open bore 36 includes a longitudinal axis 40. The lateral drift dimension of the open bore 36 is substantially equal to the lateral drift dimension of the end bores 16 and 18, but the longitudinal axis 40 of the open bore 36 is offset from the longitudinal axis 20 and 22 of the end bores 16 and 18, respectively. Lateral drift dimension is generally that dimension which will pass a certain diameter bar of a predetermined length. The mandrel may include other parts (not shown) such as a discriminator and/or orienting sleeve as shown in U.S. Pat. No. 3,741,299. Generally, the longitudinal axis 40 of the open bore 36 in conventional mandrels is aligned with the axis 20 and 22. But as has previously been discussed because of the restriction on the size of the outside diameter of the mandrel 10 and the need for thickened walls around the bores 16 and 18, the axis of the bore 36 in the present mandrel 10 is not aligned with the bores 16 and 18. In some instances this would create a restriction to the longitudinal passage of well tools in the tubing and through the mandrel 10. That is, well tools, such as 50, frequently have an outside maximum dimension or diameter only slightly smaller than the inside dimension or diameter of the tubing string and the bores 16, 18 and 36. In that case, such a well tool 50 would not be able to move between one of the bores 16 and 18 and the open bore 36 in a conventional mandrel if the open bore 36 were offset from the bores 16 and 18.

The present invention is directed to an improved sidepocket mandrel in which the open bore 36 may be offset but in which the mandrel 10 will allow the passage of a well tool 50 having a predetermined length and outside dimension which could not pass directly between one of the end bores 16 and 18 and the open bore 36. Thus, the body 10 includes a top space portion 42 above the main body portion 30 and below the upper end bore 16, and a second space portion 44 positioned below the main body portion 30 and above the lower end bore 18. The space portions 42 and 44 each includes a bore 46 and 48, respectively, having a lateral drift dimension greater than the lateral drift dimension of the open bore 36 and the end bores 16 and 18. The length of the space portions 42 and 44 is sufficient to allow the passage of a well tool 50 of a predetermined length and outside dimension to move between the end bores 16 and 18 and the open bore 36. In addition, the space portions 42 and 44 each have a length, preferably greater than the predetermined length of a well tool such as 50 whereby the well tool 50 may move between one of the end bores 16 and 18 and the open bore 36. That is, assuming the well tool 50 is leaving the top bore 16 it may completely enter the bore 46 of the top space portion 42 and be able to move laterally so as to become coaxially aligned with the axis 40 of the open bore 36 and enter therein. Similarly, as the well tool 50 moves downwardly through the open bore 36, it will encounter the bore 48 of the space portion 44. Again, the well tool 50 may move laterally in the bore 48 to become axially aligned with the longitudinal axis 22 of the lower bore 18. Therefore, the tool 50 will readily pass through the mandrel 10 even though the longitudinal axis 40 of the open bore 36 is offset from the axis of the threaded connections 16 and 14.

It is to be noted that the ends of the bores 46 and 48 encircle the abutting lower end of the upper bore 16, both ends of the open bore 36, and the upper end of the lower bore 18 so as not to impede the movement of a tool 50 into the bores 46 and 48.

Therefore the present sidepocket mandrel will act in cooperation with a well tool such as 50 adapted to be longitudinally moved through the mandrel 10 in which the tool 50 has a predetermined length and a maximum dimension slightly less than the inside dimension of the end bores 16 and 18 and the open bore 36 even though the tool 50 could not pass directly between one of the end bores 16 and 18 and the open bore 36.

The present invention, therefore, is well adapted to carry out the objects and attain the ends and advantages mentioned as well as others inherent therein. While a presently preferred embodiment of the invention has been given for the purpose of disclosure, numerous changes in the details of construction, and arrangement of parts, may be made which will readily suggest themselves to those skilled in the art and which are encompassed within the spirit of the invention and the scope of the appended claims.

What is claimed is:

1. A sidepocket mandrel for use in a well tubing comprising, a mandrel body having threaded connections about a bore at each end for connection in a well tubing, said connections being coaxially aligned, said connections having thickened walls, said body having a main portion which includes an open bore and a flow control device receiving pocket offset from the open bore, the longitudinal axis of the open bore being offset from the axis of the threaded connections, said body having a space portion above and below the main body portion for allowing the passage of a well tool of a predetermined length, said space portions having a lateral drift dimension greater than the lateral drift dimension of the open bore and the end bores and having a length sufficient to allow the lateral movement of and passage of a well tool of a predetermined length and outside dimension to move between the end bores and the open bore, and the lateral drift dimension of the open bore is substantially the same as the lateral drift dimension of the end bores through the threaded connections.

2. A sidepocket mandrel for use in a well tubing comprising, a mandrel body having threaded connections about an end bore at each end for connection in a well tubing, said end bores being coaxially aligned and said end bores having thickened walls, said body having a main portion which includes an open bore and a flow control device receiving pocket offset from the open bore, said open bore having a lateral drift dimension approximately equal to the lateral drift dimension of the end bores, the longitudinal axis of the open bore being offset from the axis of the end bores, said body having a space portion above and below the main body portion for allowing the passage of a well tool of a predetermined length and diameter which could not pass directly between an end bore and the open bore, said space portions having a lateral drift dimension greater than the lateral drift dimension of the open bore and having a length greater than the predetermined length of the well tool whereby the tool may move laterally in the space portions for alignment with an end bore or open bore.

3. A well installation comprising, a sidepocket mandrel for use in a well tubing, said mandrel including a body having threaded connections about an end bore at each end for connection in a well tubing, said end bores being coaxially aligned, said end bores having thickened walls, said body having a main portion which includes an open bore and a flow control device receiving pocket offset from the open bore, said open bore having a lateral drift dimension approximately equal to the lateral drift dimension of the end bores, the longitudinal axis of the open bore being offset from the axis of the end bores, a well tool adapted to be longitudinally moved through the mandrel, said tool having a predetermined length and a maximum outside dimension slightly less than the inside dimension of the end bores and the open bore, said body having a space portion above and below the main body portion for allowing the passage of the well tool between an end bore and the open bore which could not pass directly between an end bore and the open bore, said space portions having a lateral drift dimension greater than the lateral drift dimension of the open bore and having a length greater than the predetermined length of the well tool whereby the tool may move laterally in the space portions for alignment with an end bore or open bore.

* * * * *